US010994567B1

(12) United States Patent
Yambao et al.

(10) Patent No.: US 10,994,567 B1
(45) Date of Patent: May 4, 2021

(54) REPOSITIONABLE NOTE PADS HAVING ENHANCED FEATURES

(71) Applicants: Alexander Yambao, Las Vegas, NV (US); Ashley Yambao, Las Vegas, NV (US); Maria Eleanor P. Yambao, Las Vegas, NV (US); Allen Robert Yambao, Las Vegas, NV (US)

(72) Inventors: Alexander Yambao, Las Vegas, NV (US); Ashley Yambao, Las Vegas, NV (US); Maria Eleanor P. Yambao, Las Vegas, NV (US); Allen Robert Yambao, Las Vegas, NV (US)

( * ) Notice: Subject to any disclaimer, the term of this patent is extended or adjusted under 35 U.S.C. 154(b) by 0 days.

(21) Appl. No.: 16/986,775

(22) Filed: Aug. 6, 2020

(51) Int. Cl.
*B42D 5/00* (2006.01)

(52) U.S. Cl.
CPC ..... *B42D 5/003* (2013.01)

(58) Field of Classification Search
CPC ..... B42D 5/003
USPC ..... 281/2, 3.1, 5, 15.1, 16; 283/62, 63.1, 64
See application file for complete search history.

(56) References Cited

U.S. PATENT DOCUMENTS

2005/0163957 A1* 7/2005 Kuo ..... B42D 5/006 428/40.1
2020/0297619 A1* 9/2020 Ambrogio ..... C11D 3/381

* cited by examiner

*Primary Examiner* — Justin V Lewis

(57) ABSTRACT

A kit of notepads, comprising a first notepad having a plurality of individual repositionable sheets releasably adhered to one another to form a stack, a front portion and a rear portion, and a cleaning textile attached to the rear portion of the notepad; a second notepad having a plurality of individual repositionable sheets releasably adhered to one another to form a stack, a front portion and a rear portion, a top edge and a bottom edge, and a sheet of flexible adhesive material attached to the rear portion of the notepad, wherein the sheet of flexible adhesive material overhangs the top edge of the notepad; and a third notepad having a plurality of individual repositionable sheets releasably adhered to one another to form a stack, and a top edge and a bottom edge, wherein the corners of the top edge have been removed.

17 Claims, 1 Drawing Sheet

REPOSITIONABLE NOTE PADS HAVING ENHANCED FEATURES

BACKGROUND

The disclosed inventive subject matter relates in general to paper products used in home and office environments, and more specifically to a series of repositionable note pads having enhanced features, wherein the enhanced repositionable note pads are provided as individual products or in combination kits.

Repositionable notes, often referred to by the commercial name POST-IT© Note or the more generic term "sticky note" are small sheets of paper provided in short stacks or pads, wherein each sheet of paper in the pad includes a re-adherable strip of glue or adhesive deposited on the rear side or portion thereof. The re-adherable strip of adhesive allows each sheet to be temporarily attached to documents and other substrates and then removed without damaging the surface to which the sheet was attached. A low-tack pressure-sensitive adhesive allows such paper sheets to be easily attached, removed and even re-posted elsewhere without leaving a residue or mark. Originally provided as small yellow squares, POST-IT® Notes and related products are now available in various colors, shapes, sizes, and adhesive strengths and have become extremely common for home and office use.

Despite their popularity and widespread use, repositionable notes do suffer from certain limitations primarily due to the moderate to low tackiness or overall poor quality of the adhesive used on such products. While the temporary nature of the attachment formed by this adhesive is an important and desirable aspect of the product, many times the attachment proves to actually be too temporary, thereby resulting in notes that prematurely fall off of the surfaces to which they have been attached. Because reformulation of the adhesives used on these products would be cost prohibitive or otherwise undesirable, there is an ongoing need for methods by which to improve the performance of such products without changing their fundamental characteristics.

SUMMARY

The following provides a summary of certain example implementations of the disclosed inventive subject matter. This summary is not an extensive overview and is not intended to identify key or critical aspects or elements of the disclosed inventive subject matter or to delineate its scope. However, it is to be understood that the use of indefinite articles in the language used to describe and claim the disclosed inventive subject matter is not intended in any way to limit the described inventive subject matter. Rather the use of "a" or "an" should be interpreted to mean "at least one" or "one or more".

One implementation provides a first kit of notepads. This kit comprises a first notepad, wherein the first notepad includes a plurality of individual repositionable sheets releasably adhered to one another to form a stack, a front or top portion and a rear or bottom portion, and a cleaning textile attached to the rear or bottom portion of the notepad; and a second notepad, wherein the second notepad includes a plurality of individual repositionable sheets releasably adhered to one another to form a stack, a front or top portion and a rear or bottom portion, a top edge and a bottom edge, and a sheet of flexible adhesive material attached to the rear or bottom portion of the notepad, wherein the sheet of flexible adhesive material overhangs the top edge of the notepad. The individual repositionable sheets may be releasably adhered to one another using a low-tack adhesive. The cleaning textile may include paper, paper towel, felt, microfiber, natural fiber cloth, or synthetic fiber cloth. The cleaning textile may cover the entire rear portion of the notepad or may cover less than the entire rear portion of the notepad. The sheet of flexible adhesive material may include paper towel impregnated with adhesive.

Another implementation provides a second kit of notepads. This kit comprises a first notepad, wherein the first notepad includes a plurality of individual repositionable sheets releasably adhered to one another to form a stack, a front or top portion and a rear or bottom portion, and a cleaning textile attached to the rear or bottom portion of the notepad; and a second notepad, wherein the second notepad includes a plurality of individual repositionable sheets releasably adhered to one another to form a stack, and a top edge and a bottom edge, wherein the corners of the top edge have been removed. The individual repositionable sheets may be releasably adhered to one another using a low-tack adhesive. The cleaning textile may include paper, paper towel, felt, microfiber, natural fiber cloth, or synthetic fiber cloth. The cleaning textile may cover the entire rear portion of the notepad or may cover less than the entire rear portion of the notepad. The top edge of the second notepad may have a rounded geometry or an angled geometry.

Still another implementation provides a third kit of notepads. This kit comprises a first notepad, wherein the first notepad includes a plurality of individual repositionable sheets releasably adhered to one another to form a stack, a front or top portion and a rear or bottom portion, and a cleaning textile attached to the rear or bottom portion of the notepad; a second notepad, wherein the second notepad includes a plurality of individual repositionable sheets releasably adhered to one another to form a stack, a front or top portion and a rear or bottom portion, a top edge and a bottom edge, and a sheet of flexible adhesive material attached to the rear or bottom portion of the notepad, wherein the sheet of flexible adhesive material overhangs the top edge of the notepad; and a third notepad, wherein the third notepad includes a plurality of individual repositionable sheets releasably adhered to one another to form a stack, and a top edge and a bottom edge, wherein the corners of the top edge have been removed. The individual repositionable sheets may be releasably adhered to one another using a low-tack adhesive. The cleaning textile may include paper, paper towel, felt, microfiber, natural fiber cloth, or synthetic fiber cloth. The cleaning textile may cover the entire rear portion of the notepad or may cover less than the entire rear portion of the notepad. The sheet of flexible adhesive material may include paper towel impregnated with adhesive. The top edge of the second notepad may have a rounded geometry or an angled geometry.

It should be appreciated that all combinations of the foregoing concepts and additional concepts discussed in greater detail below (provided such concepts are not mutually inconsistent) are contemplated as being part of the inventive subject matter disclosed herein and may be implemented to achieve the benefits as described herein. Additional features and aspects of the disclosed system, devices, and methods will become apparent to those of ordinary skill in the art upon reading and understanding the following detailed description of the example implementations. As will be appreciated by the skilled artisan, further implementations are possible without departing from the scope and spirit of what is disclosed herein. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more example implementations of the disclosed inventive subject matter and, together with the general description given above and detailed description given below, serve to explain the principles of the disclosed subject matter, and wherein.

DETAILED DESCRIPTION

Figure 1A:
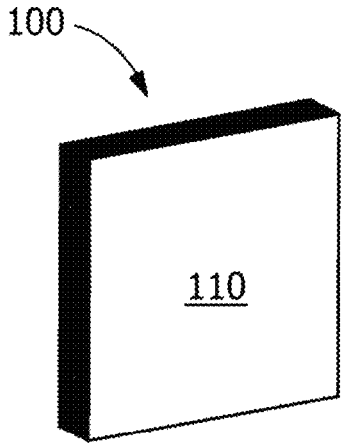
FIG. 1A is a front view of a first example implementation of an enhanced notepad wherein a substrate-cleaning material has been attached to the bottom of the notepad.

Example implementations are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the disclosed inventive subject matter. Accordingly, the following implementations are set forth without any loss of generality to, and without imposing limitations upon, the claimed subject matter.

Example implementations provide pads of repositionable notes having enhanced or improved characteristics. A first example enhanced notepad includes a pad of individual repositionable sheets that includes a two-sided material attached to part or all of the rear or bottom portion of the pad, wherein the outward facing side includes a cleaning textile for removing dust, dirt, debris, or other particulate matter from a substrate prior to attaching an individual repositionable note thereto. A second example enhanced notepad includes a pad of individual repositionable sheets having a two-sided flexible material attached to part or all of the rear or bottom portion of the pad, wherein the outward facing side includes a sticky or tacky material that allows the entire notepad to be securely hung on a vertical surface. A third example note pad includes a pad of individual repositionable sheets, the upper corners of which have been rounded off or otherwise modified to prevent the upper corners from curling away from a surface to which an individual repositionable sheet has been attached. When provided in various combinations with one another or as a kit, these enhanced notepads may be referred to as the "All-In-One Notepad" or the "Ultimate Notepad".

Figure 1B:
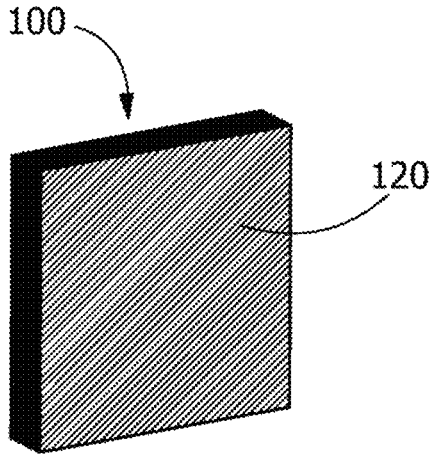
FIG. 1B is a rear view of the notepad of FIG. 1A, wherein the substrate-cleaning material is shown.

FIGS. 1A-1B depict a pad of individual repositionable sheets that includes a two-sided material attached to part or all of the rear or bottom portion of the pad, wherein the outward facing side includes a cleaning textile. FIG. 1A depicts the front of pad 100 and FIG. 1B depicts the rear of pad 100. In FIG. 1A, top sheet 110 is shown and in FIG. 2B, cleaning textile 120 is shown. With regard to this implementation, the term textile can mean any suitable cleaning fabric or material such as, for example paper towel, felt, microfiber, natural fiber cloth, or synthetic fiber cloth. Prior to removing an individual repositionable sheet, the user of this implementation uses the cleaning textile to clean the surface to which the individual sheet will be attached. Cleaning the surface in this manner allows the adhesive strip on the back of the individual sheet to function more effectively than had the surface not been cleaned and the individual sheet will therefor stick to the surface much more securely and for a much longer period of time. This implementation may be referred to as the "Wipe N' Stick Pad".

Figure 2A:
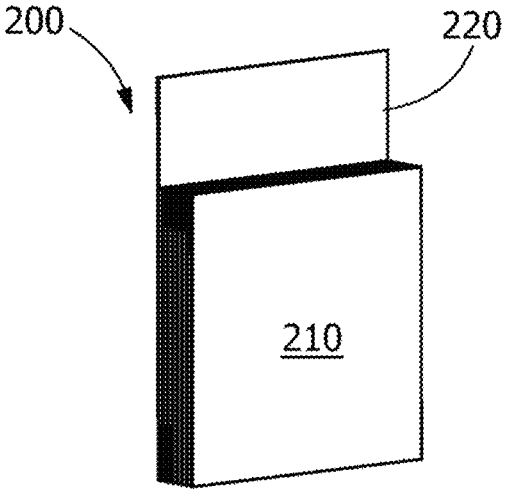
FIG. 2A is a front view of a second example implementation of an enhanced notepad wherein a flexible adhesive material has been attached to the bottom of the notepad for allowing the notepad to be hung from vertical surfaces.
Figure 2B:
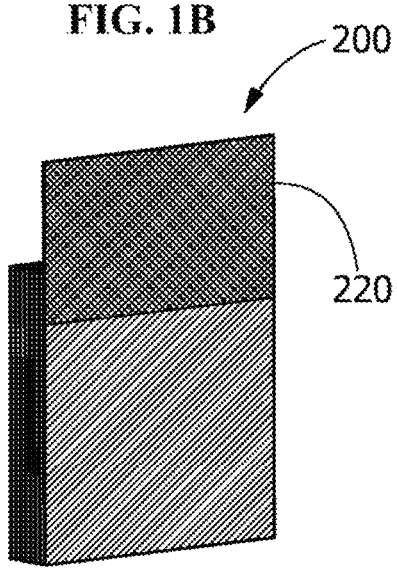
FIG. 2B is a rear view of the notepad of FIG. 2A, wherein the flexible adhesive material is shown.

FIGS. 2A-2B depict a pad of individual repositionable sheets having a two-sided flexible material attached to part or all of the rear or bottom portion of the pad, wherein the outward facing side includes a sticky or tacky material that allows the entire notepad to be securely hung on vertical surfaces, such as for example, those found on cabinets or refrigerators. FIG. 2A depicts the front of pad 200 and FIG. 2B depicts the rear of pad 200. In FIG. 2A, top sheet 210 is shown and in FIG. 2B, flexible adhesive material 220 is shown. With regard to this implementation, flexible adhesive material 220 may be absorbent paper towel or paper towel-like material impregnated with or coated with a layer of low-tack adhesive or glue. Proper impregnation of this paper towel material results in a lack of residual surface tackiness, thereby eliminating the need for release paper to protect the adhesive surface of the material. Flexible adhesive material 220 typically extends above (e.g., overhangs) the upper edge of the notepad so that flexible material 220 may be easily grasped for the removal and relocation of the notepad. The flexibility of material 220 allows the notepad to be attached to or mounted on surfaces that may not be entirely flat. This implementation may be referred to as the "Stick Anywhere Pad". This configuration may be used with the implementation disclosed below.

Figure 3A:
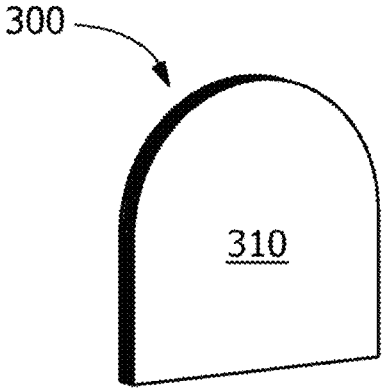
FIG. 3A a front view of a third example implementation of an enhanced notepad wherein the upper corners of the pad have been rounded to prevent the upper edge of an individual note from curling after the individual sheet has been removed from the pad and attached to the surface of a substrate.
Figure 3B:
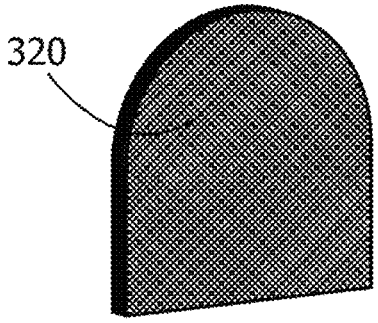
FIG. 3B is a rear view of the notepad of FIG. 3A.

FIGS. 3A-3B depict a pad of individual repositionable sheets wherein the upper corners of the pad have been rounded to remove the typically square portion of the low-tack adhesive strip that is used to both hold the individual sheets together in the pad and to reversibly attach each individual sheet to a surface or substrate. Removing or modifying the upper corners of pad 300 eliminates the tendency of an individual sheet to curl at the upper corners thereof and become prematurely detached from a surface to which the sheet has been attached. Such curling results from "paper memory" created during the process of removing an individual sheet from a pad. FIG. 3A depicts the front of pad 300 and FIG. 3B depicts the rear of the pad 300. In FIG. 3A, top sheet 310 is shown and in FIG. 2B, bottom sheet 320 is shown. In FIGS. 3A-3B, pad 300 is shown with curved upper edges; however, in other implementations the upper edges are both cut at an angle of about 45°. This implementation may be referred to as the "No Curl Pad". This geometric configuration may be used with the first implementation disclosed above.

Any literature and similar material cited in this application, including, but not limited to, patents, patent applications, articles, books, treatises, and web pages, regardless of the format of such literature and similar materials, are expressly incorporated by reference in their entirety. In the event that one or more of the incorporated references and similar materials differs from or contradicts this application, including but not limited to defined terms, term usage, described techniques, or the like, this application controls.

As previously stated and as used herein, the singular forms "a," "an," and "the," refer to both the singular as well as plural, unless the context clearly indicates otherwise. The term "comprising" as used herein is synonymous with "including," "containing," or "characterized by," and is inclusive or open-ended and does not exclude additional, unrecited elements or method steps. Although many methods and materials similar or equivalent to those described herein can be used, particular suitable methods and materials are described herein. Unless context indicates otherwise, the recitations of numerical ranges by endpoints include all numbers subsumed within that range. Furthermore, references to "one implementation" are not intended to be interpreted as excluding the existence of additional implementations that also incorporate the recited features. Moreover, unless explicitly stated to the contrary, implementations "comprising" or "having" an element or a plurality of elements having a particular property may include additional elements whether or not they have that property.

The terms "substantially" and "about" used throughout this specification are used to describe and account for small fluctuations, such as due to variations in processing. For example, these terms can refer to less than or equal to 5%, such as less than or equal to 2%, such as less than or equal to 1%, such as less than or equal to 0.5%, such as less than or equal to 0.2%, such as less than or equal to 0.1%, such as less than or equal to 0.05%, and/or 0%.

Underlined and/or italicized headings and subheadings are used for convenience only, do not limit the disclosed subject matter, and are not referred to in connection with the interpretation of the description of the disclosed subject matter. All structural and functional equivalents to the elements of the various implementations described throughout this disclosure that are known or later come to be known to those of ordinary skill in the art are expressly incorporated herein by reference and intended to be encompassed by the disclosed subject matter. Moreover, nothing disclosed herein is intended to be dedicated to the public regardless of whether such disclosure is explicitly recited in the above description.

There may be many alternate ways to implement the disclosed inventive subject matter. Various functions and elements described herein may be partitioned differently from those shown without departing from the scope of the disclosed inventive subject matter. Generic principles defined herein may be applied to other implementations. Different numbers of a given module or unit may be employed, a different type or types of a given module or unit may be employed, a given module or unit may be added, or a given module or unit may be omitted.

It should be appreciated that all combinations of the foregoing concepts and additional concepts discussed in greater detail herein (provided such concepts are not mutually inconsistent) are contemplated as being part of the disclosed inventive subject matter. In particular, all combinations of claimed subject matter appearing at the end of this disclosure are contemplated as being part of the inventive subject matter disclosed herein. While the disclosed inventive subject matter has been illustrated by the description of example implementations, and while the example implementations have been described in certain detail, there is no intention to restrict or in any way limit the scope of the appended claims to such detail. Additional advantages and modifications will readily appear to those skilled in the art. Therefore, the disclosed inventive subject matter in its broader aspects is not limited to any of the specific details, representative devices and methods, and/or illustrative examples shown and described. Accordingly, departures may be made from such details without departing from the spirit or scope of the general inventive concept.

What is claimed:

1. A kit of notepads, comprising:

(a) a first notepad, wherein the first notepad includes
  (i) a plurality of individual repositionable sheets releasably adhered to one another to form a stack,
  (ii) a front or top portion and a rear or bottom portion, and
  (iii) a cleaning textile attached to the rear or bottom portion of the notepad, wherein the cleaning textile covers less than the entire rear portion of the first notepad; and (b) a second notepad, wherein the second notepad includes
  (i) a plurality of individual repositionable sheets releasably adhered to one another to form a stack,
  (ii) a front or top portion and a rear or bottom portion,
  (iii) a top edge and a bottom edge, and
  (iv) a sheet of flexible adhesive material attached to the rear or bottom portion of the second notepad, wherein the sheet of flexible adhesive material overhangs the top edge of the second notepad.

2. The kit of claim 1, wherein the individual repositionable sheets are releasably adhered to one another using a low-tack adhesive.

3. The kit of claim 1, wherein the cleaning textile includes paper towel, felt, microfiber, natural fiber cloth, or synthetic fiber cloth.

4. The kit of claim 1, wherein the cleaning textile covers the entire rear portion of the first notepad.

5. The kit of claim 1, wherein the sheet of flexible adhesive material includes paper towel impregnated with adhesive.

6. A kit of notepads, comprising:

(a) a first notepad, wherein the first notepad includes
  (i) a plurality of individual repositionable sheets releasably adhered to one another to form a stack,
  (ii) a front or top portion and a rear or bottom portion, and
  (iii) a cleaning textile attached to the rear or bottom portion of the notepad, wherein the cleaning textile covers less than the entire rear portion of the first notepad; and (b) a second notepad, wherein the second notepad includes
  (i) a plurality of individual repositionable sheets releasably adhered to one another to form a stack, and
  (ii) a top edge and a bottom edge,
  (iii) wherein corners of the top edge have been removed.

7. The kit of claim 6, wherein the individual repositionable sheets are releasably adhered to one another using a low-tack adhesive.

8. The kit of claim 6, wherein the cleaning textile includes paper towel, felt, microfiber, natural fiber cloth, or synthetic fiber cloth.

9. The kit of claim 6, wherein the cleaning textile covers the entire rear portion of the first notepad.

10. The kit of claim 6, wherein the top edge of the second notepad has a rounded geometry.

11. The kit of claim 6, wherein the top edge of the second notepad has an angled geometry.

12. A kit of notepads, comprising:

(a) a first notepad, wherein the first notepad includes (i) a plurality of individual repositionable sheets releasably adhered to one another to form a stack, (ii) a front or top portion and a rear or bottom portion, and (iii) a cleaning textile attached to the rear or bottom portion of the notepad, wherein the cleaning textile covers less than the entire rear portion of the first notepad;

(b) a second notepad, wherein the second notepad includes (i) a plurality of individual repositionable sheets releasably adhered to one another to form a stack, (ii) a front or top portion and a rear or bottom portion, (iii) a top edge and a bottom edge, and (iv) a sheet of flexible adhesive material attached to the rear or bottom portion of the second notepad, wherein the sheet of flexible adhesive material overhangs the top edge of the second notepad; and (c) a third notepad, wherein the third notepad includes (i) a plurality of individual repositionable sheets releasably adhered to one another to form a stack, and (ii) a top edge and a bottom edge, (iii) wherein corners of the top edge of the third notepad have been removed.

13. The kit of claim 12, wherein the individual repositionable sheets are releasably adhered to one another using a low-tack adhesive.

14. The kit of claim 12, wherein the cleaning textile includes paper towel, felt, microfiber, natural fiber cloth, or synthetic fiber cloth.

15. The kit of claim 12, wherein the cleaning textile covers the entire rear portion of the first notepad.

16. The kit of claim 12, wherein the sheet of flexible adhesive material includes paper towel impregnated with adhesive.

17. The kit of claim 12, wherein the top edge of the third notepad has either a rounded geometry or an angled geometry.

* * * * *